US006041803A

United States Patent [19]

De Almeida et al.

[11] Patent Number: 6,041,803

[45] Date of Patent: Mar. 28, 2000

[54] DEVICE AND METHOD FOR ELIMINATING SEVERE SLUGGING IN MULTIPHASE-STREAM FLOW LINES

[75] Inventors: Alcino Resende De Almeida; Marcelo De Albuquerque Lima Gonçalves, both of Rio de Janeiro, Brazil

[73] Assignee: Petroleo Brasileiro S.A. -Petrobras, Brazil

[21] Appl. No.: 09/383,278

[22] Filed: Aug. 26, 1999

[30] Foreign Application Priority Data

Sep. 17, 1998 [GB] United Kingdom ..... 9820277

[51] Int. Cl.[7] ..... B01F 3/04

[52] U.S. Cl. ..... 137/14; 137/236.1; 261/19; 261/64.3

[58] Field of Search ..... 137/236.1, 14; 261/19, 64.3; 138/44, 45

[56] References Cited

U.S. PATENT DOCUMENTS 5,445,356 8/1995 Walsh et al. ..... 137/236.1 X
5,478,504 12/1995 de Almeida Barbuto .
5,797,421 8/1998 Merrett ..... 137/236.1
5,851,385 12/1998 Merrett ..... 137/236.1 X

FOREIGN PATENT DOCUMENTS 0 034 079 8/1981 Germany .
2 280 460 2/1995 United Kingdom .
2 282 399 4/1995 United Kingdom .

OTHER PUBLICATIONS

Schmidt et al, "Choking Can Eliminate Severe Pipeline Slugging"; Oil & Gas Journal; Nov. 12, 1979; pp. 230–238.

*Primary Examiner*—Kevin Lee
*Attorney, Agent, or Firm*—Nixon & Vanderhye PC

[57] ABSTRACT

The present invention relates to a device located near to the point of junction of a multiphase-stream underwater flow line with a stratified phase pattern, and an underwater riser, which introduces a pressure drop into the flow and causes a vigorous mixing effect, temporarily converting this flow into a non-stratified pattern of flow, such as an annular stream, thereby preventing the establishment of the phenomenon of severe slugging.

9 Claims, 3 Drawing Sheets

DEVICE AND METHOD FOR ELIMINATING SEVERE SLUGGING IN MULTIPHASE-STREAM FLOW LINES

FIELD OF THE INVENTION

The present invention is designed to remedy the harmful effects of that the phenomenon known as "severe slugging" on activities involving a multiphase-fluid flow, such as in offshore petroleum production.

PRIOR ART

The phenomenon of severe slugging, or severe intermittent flow, is characterized by major oscillations in pressure levels and in the rate of flow of a multiphase flow in which both gases and liquids are present. The length of the typical liquid slug increases and may even reach from 1 to several riser lengths in extreme cases. In particular, in offshore petroleum production activities severe slugging has harmful effects which may seriously jeopardise production.

When commercially exploiting an offshore petroleum field, it is necessary for the oil produced to flow via pipes from the wells to the surface production unit. Underwater flow lines coming from the wells and located on the ocean floor are usually connected at a certain point to ascending underwater flow lines, known by specialists as "risers", which convey the produced fluids up to the surface.

Severe slugging occurs when two conditions are fulfilled. These are:

(i) a stratified descending stream with a low flow rate in the underwater flow line, and (ii) the underwater flow line includes an underwater riser. Under certain circumstances, the slope of the flow line and the velocity of the multiphase oil/gas flow create conditions under which the stream in the flow line becomes stratified, i.e. the stream has to assume a stratified-type flow pattern, that is to say with practically separate phases of liquid and gas, with the gas flowing above the liquid. This segregation of the gas into the upper part of the inclined flow line is the determining factor for the establishment of the severe-slugging phenomenon.

Owing to its highly transient nature, severe slugging causes significant oscillation in pressure levels and in the rate of flow of the produced fluids and, in extreme cases, may even give rise to production being shut down.

Severe slugging is a cyclical process. At a specific stage of the cycle the liquid begins to accumulate in the underwater riser and acts as a liquid seal, blocking the passage of the gas. The gas then begins to be compressed inside the flow line. When the pressure on the gas increases sufficiently to overcome the hydrostatic pressure exerted by the column of liquid which has accumulated in the underwater riser, the gas then expands and pushes the liquid upwards in the riser towards a surface collection point, which is usually a separator vessel.

Once expansion has occurred, the rate of flow of gas returns to low levels. The two phases then once again take on a high degree of slip, with the liquid tending to accumulate once more in the underwater riser, the cycle repeats itself.

Thus, the phenomenon of severe slugging means that there are periods, when the condition for severe slugging occurs in the underwater flow line and in the riser, during which there is practically no production of liquid or gas, these periods being interspersed with others when high rates of flow of liquid and gas occur.

This is highly undesirable on account of the resulting major fluctuations in pressure and in the rate of flow, since the high level of production of liquid may, for example, cause an overflow and shutdown at the surface separator vessel, with detrimental consequences for production. In addition, fluctuations in gas production may give rise to operational problems with the gas flare and may also cause high pressures which tend to inhibit well production capacity.

The phenomenon of severe slugging also occurs in situations when a flow line on land lies on hilly terrain. Severe slugging arises in a manner similar to that described above owing to the existence of (i) a descending section with multiphase flow, with a stratified phase pattern, followed by (ii) an ascending section. This configuration may even be repeated at various points along the entire length of the flow line. This is therefore a similar problem to that which occurs in an inclined underwater flow line/riser system and therefore the solutions provided for one case may, in principle, be applied to the other.

There are basically two approaches which can be adopted to reduce or eliminate the effects of severe slugging. In the first, an attempt is made to influence the actual flow and, in the second, an attempt is made to alter the production facilities.

The solutions most commonly used to influence the flow are related to choking on the surface or gas lift at the base of the riser.

In the first case, stabilization of the flow is achieved by introducing a localised pressure drop (head loss) due to a choke to the flow, at the top of the riser. The counterpressure imposed by the choke at the surface is proportional to the velocity flow past it. In this way, slugging is halted and the flow may be stabilized. In addition to it not always being possible successfully to halt slugging, the disadvantage of this solution is that the restriction of the flow may be excessive, which forces the flow to stabilize at an average stream pressure which is much greater than the pressure which arises during severe slugging, and this brings about a loss in production.

(The use of a choke to control severe slugging is referred to in Oil and Gas Journal 12 November 1979 at pages 230 to 238.

With gas lift, an attempt is made to reduce the hydrostatic pressure of the column of liquid in the riser with a view to achieving a reduction in pressure in the line and keeping the liquid moving in the riser. However, this solution is relatively complex to set up and relatively expensive, and requires an availability of both gas, and equipment for compressing the gas, which are not always found in a given situation.

GB-A-2280460 discloses a lining for reducing the flow cross-section of a riser in order to accommodate slug-free flow at reduced flow rates, for example at the end of well life.

EP-A-0034079 discloses a chain of various elements which break up the two-phase flow to homogenize it.

Another solution to severe slugging, in which the production facilities are altered, is proposed in our GB-A-2,282,399. This solution includes the installation of at least one auxiliary secondary line which begins in the descending underwater flow line and ends in the underwater riser which conveys the fluids up to the surface production unit.

This auxiliary secondary line collects the segregated gas at the top of the underwater flow line, at a point located at a predetermined distance from the junction of the underwater flow line and the underwater riser, and transports the gas as far as a point located along the underwater riser at a predetermined distance from that junction. The pressure differential which exists between the points of intersection provides the stream of gas between these points.

This solution has the sole disadvantage of being relatively costly, principally in situations where the auxiliary line is long.

There is therefore a need for a novel solution to the problem of severe slugging. The present invention proposes a solution to the problem which is simple and inexpensive.

SUMMARY OF THE INVENTION

A first aspect of the present invention provides a flow line including a device for eliminating severe slugging in a stratified multiphase-stream in the flow line, wherein said device comprises a body positioned in the said flow line where the stream having passed through the interior of the device continues through a riser of the flow line; and wherein the interior of said body defines an internal passage which has a convergent nozzle section and a divergent diffuser section creating a geometric configuration such that it introduces a pressure drop which promotes a reorganization of phases in a stratified multiphase flow, thereby converting this flow from a stratified stream into a non-stratified pattern of flow. The flow line may be an underwater flow line conveying a multiphase-fluid stream basically coming from the production of offshore petroleum wells. The device is preferably located near to the point of junction of this underwater flow line and an underwater riser which conveys the multiphase stream to the surface. The non-stratified flow pattern may for example be an annular stream, a bubble stream, etc.

The device of the first aspect of the present invention has a geometry such that it introduces into the flow a pressure drop which makes it possible to rearrange the phases temporarily, converting a stratified flow into a non-stratified flow pattern for a flow path length sufficient to prevent the establishment of the severe-slugging phenomenon.

In a preferred embodiment, use is made of a concentric venturi to achieve the above-mentioned rearrangement of phases. Their geometrical configurations may provide adequate operational results.

A second aspect of the invention provides a method of eliminating severe slugging in a stratified multiphase stream in a flow line comprising propelling the multiphase stream through a device as defined in the first aspect under conditions such that the stratified stream is converted into an annular stream for a flow path length sufficient to prevent the establishment of the phenomenon of severe slugging.

BRIEF DESCRIPTION OF THE DRAWINGS

The invention will now be described in greater detail in conjunction with the drawings which accompany the present description, in which.

DETAILED DESCRIPTION OF THE INVENTION

Figure 1:
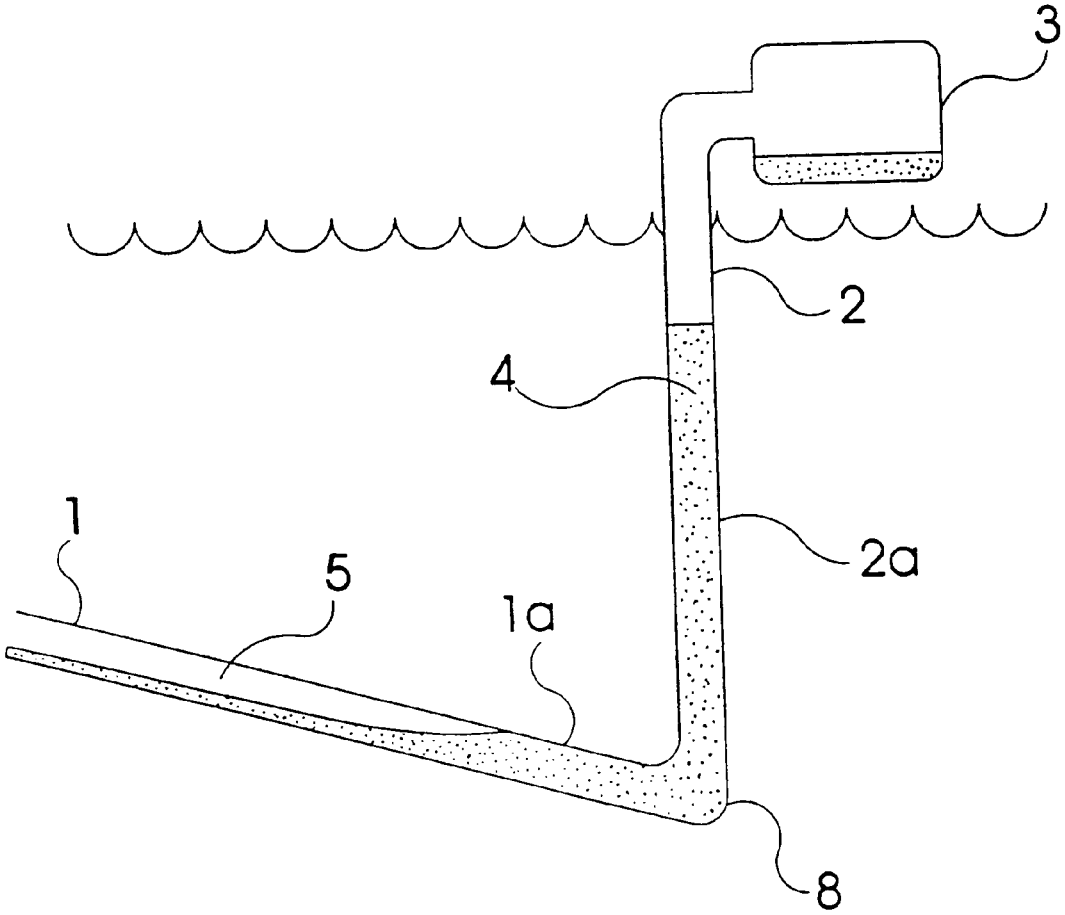
FIG. 1 is a diagrammatic illustrative view of a descending flow line connected to an underwater riser in which severe slugging is likely to occur.

FIG. 1 shows a diagrammatic illustrative view of an underwater flow line 1, with a descending profile, connected to an underwater riser 2. As may be seen, in this embodiment the underwater riser 2 is connected purely by way of example to a separator vessel 3.

In the situation shown in FIG. 1, there may be seen a column of liquid phase 4 which totally fills the interior of a portion 2*a* of the underwater riser 2. It should also be noted that a descending end portion l*a* of the underwater flow line 1, located near to the point of junction 8 of the line 1 with the underwater riser 2, is also completely filled with the liquid 4 thereby forming a liquid seal which blocks the passage of the gaseous phase 5 into the interior of the underwater riser 2.

This creates the conditions under which severe slugging occurs; for this to happen it merely requires the pressure of the gaseous phase 5 to be sufficient to overcome the hydrostatic pressure exerted by the column of liquid phase 4 which has accumulated in the underwater riser 2.

To prevent such situations arising, the present invention proposes the use of a device for inhibiting severe slugging by introducing a localised pressure drop, preferably close to the point of junction of the underwater flow line 1 and the underwater riser 2, which brings about a rearrangement of phases with a view to preventing the phenomenon.

Figure 2:
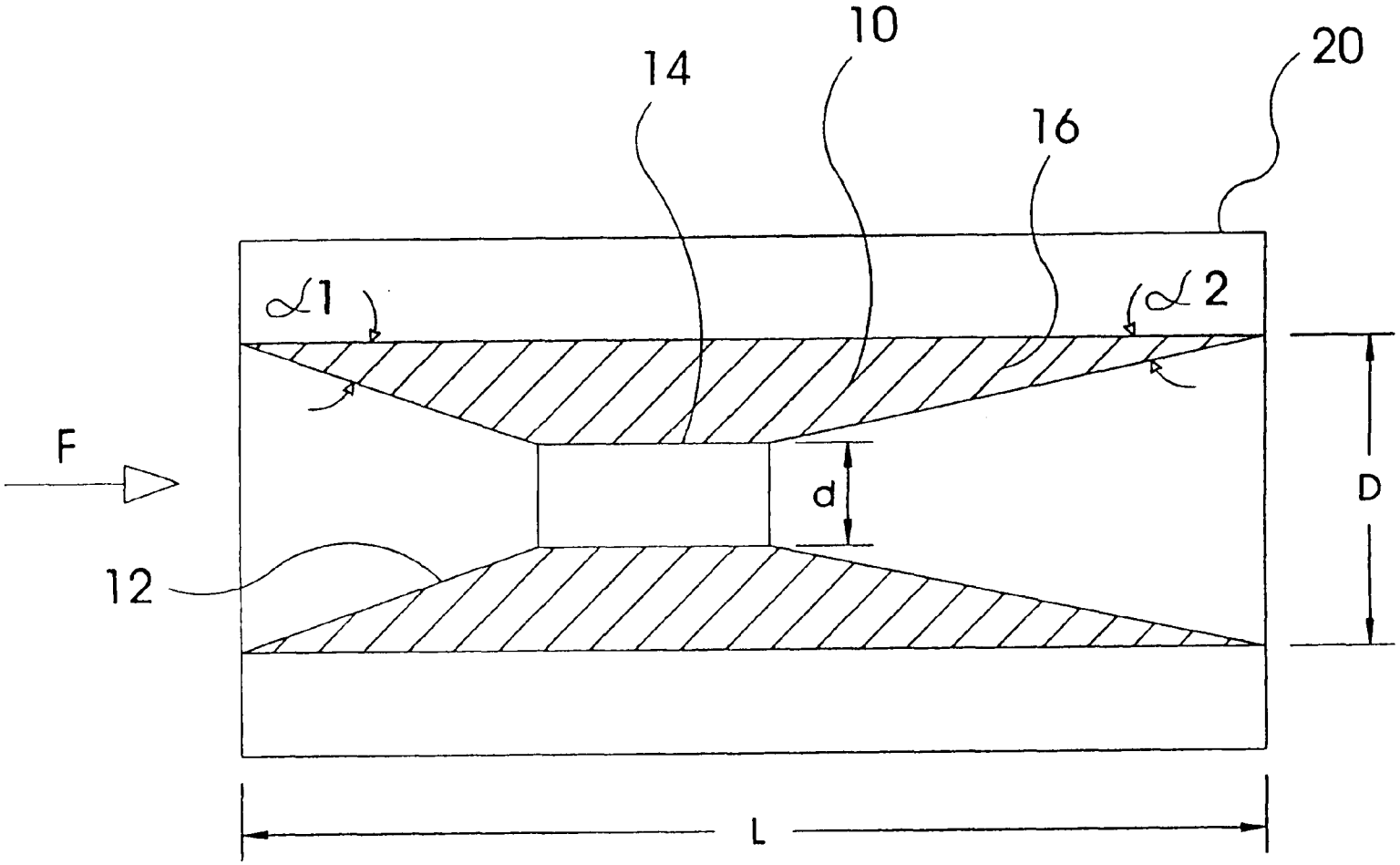
FIG. 2 is an illustrative, sectional view of an embodiment of the device of the present invention intended to reduce the effects of severe slugging.

In the present embodiment, it is proposed that this device, shown in its more general form in FIG. 2, be a body 20 which, in its internal portion, has a concentric venturi 10 which is provided with: a generally convergent nozzle 12, a generally straight section 14, and a generally divergent diffuser 16. It should be pointed out that the straight section 14 may be very small or even absent in some cases. The terms "convergent" and "divergent" relate to the direction of flow, which is indicated in FIG. 2 by the arrow F. For the purposes of simplification of the present description, it should be understood that any reference made below to the concentric venturi 10 should be regarded as a reference to the device of the present invention.

The basic action of the concentric venturi 10 is to create a vigorous mixing of the gaseous phase with the liquid phase, converting the generally stratified flow which is established upstream of the concentric venturi 10 into a non-stratified pattern of flow, preferably a generally annular flow, downstream of the concentric venturi 10.

Tests carried out by the Applicants on models showed that the flow tends to return to the previous situation, seeking stability. In other words, if the flow were to continue on line, there would be a return to the stratified flow. However, the correct positioning of the concentric venturi 10 in the underwater flow line 1 and its correct dimensioning (length L, entry angle $\alpha 1$, exit angle $\alpha 2$, diameter D of the concentric venturi, diameter d of the straight section 14—see FIG. 2) enable the unstable new pattern of phases to be successfully maintained for a flow path length extending up to the point of junction 8 of the underwater flow line 1 and the underwater riser 2.

This inhibits the phenomenon of severe slugging since what is actually established is a flow of phases with minor slugging, which is perfectly normal in multiphase risers and presents no operational problems for the surface production facilities.

A secondary desirable effect, introduced by the concentric venturi 10, is the release of a large quantity of gas in the straight section 14 and its surroundings due to the major reduction in pressure which occurs in this section. This gas was originally in solution in the oil and, released for an instant, tends to return into solution. However, before this happens, the existence of a higher rate of flow of gas even further promotes the establishment of the non-stratified (annular) phase pattern and, depending on conditions, promotes greater gasification of the vertical flow in the riser, which also favours elimination of the phenomenon of severe slugging.

Figure 3:
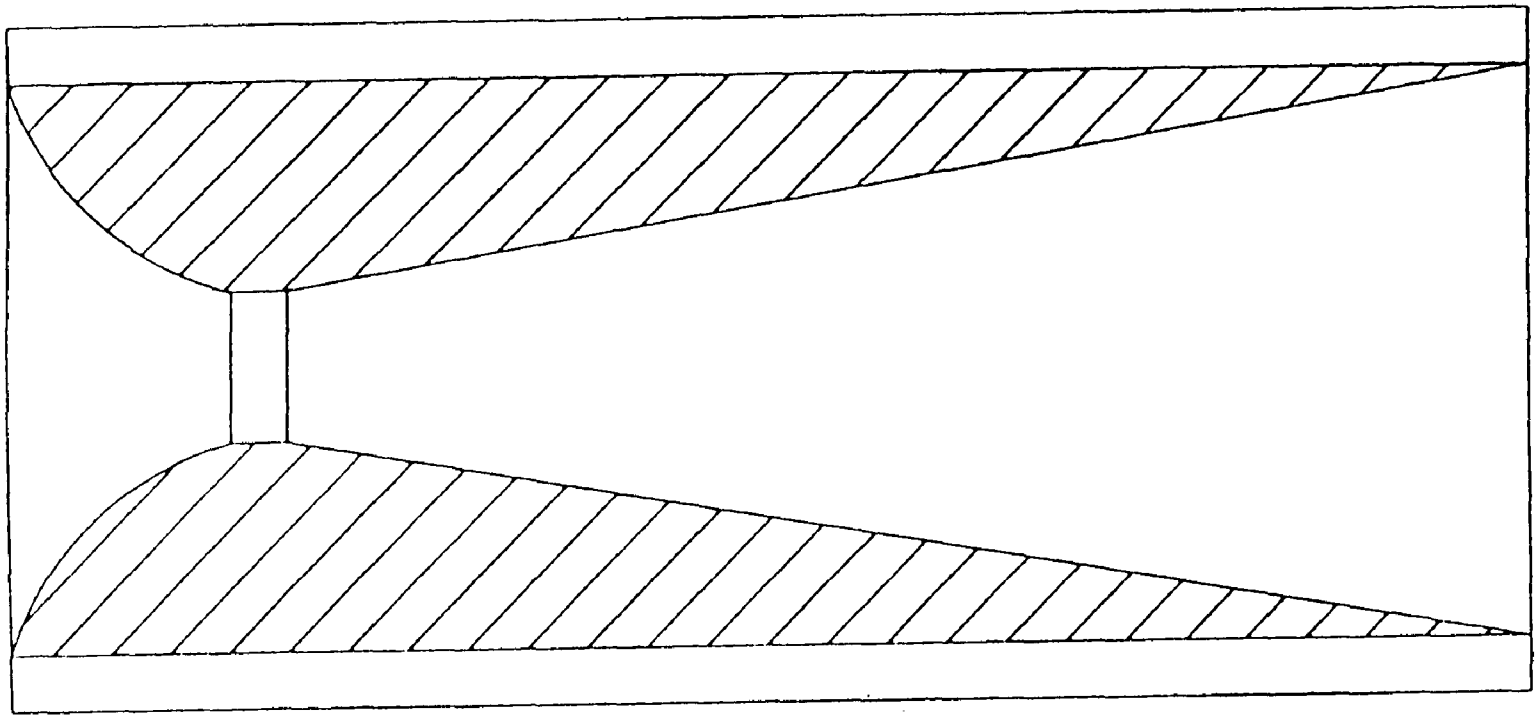
FIG. 3 is an illustrative, sectional view of an embodiment of the device which is the subject of the present invention, with optimized geometry, intended to reduce the effects of severe slugging.

The concentric venturi 10 introduces into the flow a local pressure drop which may be minimized by the optimized geometry of the concentric venturi 10. An example of this optimized geometry may be seen in FIG. 3 which shows a classical profile of a concentric venturi in which the conical converging nozzle is advantageously replaced by a converging nozzle with a gentle curvature. The surface finish is also an important factor in reducing the pressure drop to the minimum necessary for achieving the desired rearrangement of phases. In tests carried out by the Applicants, the configuration of FIG. 2 was adopted, owing to the ease of manufacture and also because the results of checking the performance of the device are qualitatively similar to those which might be obtained with a concentric venturi similar to that in FIG. 3.

In addition to this it is anticipated that, once the condition of severe slugging has been eliminated, the average flow pressure with the use of the concentric venturi 10 will be less than that prevailing in the unstable flow with severe slugging.

Thus, when correctly dimensioned, the device of the present invention eliminates significant fluctuations in pressure and rate of flow, normalizing the flow and making more stable the operation of the surface production facilities to which the fluids produced are conveyed. In addition to this, as the average pressure of the flow is more stable than that obtained with the flow at a time of severe slugging, the production capacity of the well(s) may be increased since production from the well(s) will encounter a lower counterpressure in the underwater flow line 1.

The device of the present invention may have a simple construction, be inexpensive to manufacture, and be installed in a flow line in a variety of ways. For example, the device may be constructed in the form of a spool, to be placed preferably near to the point of junction 8 of the underwater flow line 1 with the underwater riser 2. Those skilled in the art will immediately perceive that there are countless other options for installing the device of the present invention without, however, departing from the scope of the present invention.

Although the inventors conclude that, in terms of geometry, the concentric venturi 10 is the option which is most suitable for the device of the present invention, they acknowledge that other geometries may be used. Other such geometry options may, for example, be concentric or eccentric (circular or noncircular) orifices, convergent nozzles, perforated plates, etc.; and even an eccentric venturi is an option for the geometry of the device of the present invention.

In fact the essence of the present innovation lies in installing, in a stratified-flow line, a device which introduces a local pressure drop to promote a fluid acceleration and a simple reorganization of phases, albeit a momentary one, for the elimination of the condition of severe slugging.

Although the invention has been described here with reference to its most recommendable embodiment, the above description may not be regarded as restricting the present invention, which is limited only by the scope of the following claims.

We claim:

1. In a flow line including a riser and a device for eliminating severe slugging in a stream in the flow line, the device comprising a body having a convergent nozzle section positioned in said flow line where the stream is about to enter said riser of the flow line; the improvement wherein the body further includes a divergent diffuser section, the convergent nozzle section and the divergent diffuser section defining an internal passage of the body with a geometric configuration such that it introduces a pressure drop which promotes a reorganization of phases in a stratified multiphase flow, thereby converting said stratified multiphase flow from a stratified stream into a non-stratified flow pattern in said stream which, having passed through the interior of the device, continues through said riser.

2. Apparatus according to claim 1, wherein the geometrical configuration of the internal passage defined by said body has the form of at least one concentric orifice.

3. Apparatus according to claim 2, wherein the geometrical configuration of the internal passage defined by said body is a concentric venturi further including a straight section.

4. Apparatus according to claim 1, wherein the geometrical configuration of the internal passage defined by said body is an eccentric venturi.

5. Apparatus according to claim 4, wherein the geometrical configuration of the internal passage defined by said body has the form of at least one eccentric orifice further including a straight section.

6. Apparatus according to claim 1, wherein the geometrical configuration of the internal passage defined by said body has the form of several convergent nozzles.

7. Apparatus according to claim 1, wherein said body is near to the point of junction of descending sections and ascending sections of the flow line.

8. In a method of eliminating severe slugging in a stratified multiphase stream in a flow line comprising positioning in the flow line a device for eliminating severe slugging in a stream in the flow line; the improvement wherein the device is positioned where the stream is about to enter a riser of the flow line, and wherein the device comprises a convergent nozzle section followed by a divergent diffuser section which together define an internal passage of the body with a geometric configuration such that it introduces a pressure drop which promotes a reorganization of phases in a stratified multiphase flow, and wherein the multiphase stream is propelled through said device under conditions such that the stratified stream is converted into a non-stratified pattern of flow for a flow path length sufficient to prevent the establishment of the phenomenon of severe slugging.

9. A method according to claim 8, wherein the device is positioned near the junction of an underwater flow line and a riser.

* * * * *